US009925403B1

(12) United States Patent
Zarli

(10) Patent No.: US 9,925,403 B1
(45) Date of Patent: Mar. 27, 2018

(54) EXERCISE DESK

(71) Applicant: Michael Zarli, Providence, RI (US)

(72) Inventor: Michael Zarli, Providence, RI (US)

( * ) Notice: Subject to any disclaimer, the term of this patent is extended or adjusted under 35 U.S.C. 154(b) by 38 days.

(21) Appl. No.: 15/088,234

(22) Filed: Apr. 1, 2016

Related U.S. Application Data

(60) Provisional application No. 62/178,194, filed on Apr. 2, 2015.

(51) Int. Cl.

| | |
|---|---|
| ***A63B 1/00*** | (2006.01) |
| ***A63B 3/00*** | (2006.01) |
| ***A63B 21/00*** | (2006.01) |
| ***A63B 21/068*** | (2006.01) |
| ***A63B 23/12*** | (2006.01) |
| ***A47B 13/10*** | (2006.01) |
| ***A47B 13/08*** | (2006.01) |
| ***A47B 83/00*** | (2006.01) |
| ***A47B 83/04*** | (2006.01) |

(52) U.S. Cl.
CPC ..... *A63B 1/00* (2013.01); *A47B 13/083* (2013.01); *A47B 13/10* (2013.01); *A47B 83/001* (2013.01); *A47B 83/045* (2013.01); *A63B 3/00* (2013.01); *A63B 21/00047* (2013.01); *A63B 21/068* (2013.01); *A63B 21/4035* (2015.10); *A63B 23/1218* (2013.01); *A63B 23/1227* (2013.01); *A63B 2210/06* (2013.01)

(58) Field of Classification Search
CPC ..... A47B 83/00; A47B 83/001; A47B 83/04; A47B 13/083; A47B 13/10; A63B 1/00; A63B 23/1218; A63B 23/1227; A63B 21/00047; A63B 21/068; A63B 21/4035; A63B 3/00
USPC ..... 108/29, 181, 182, 50.11
See application file for complete search history.

(56) References Cited

U.S. PATENT DOCUMENTS

| | | | | |
|---|---|---|---|---|
| 3,521,881 | A * | 7/1970 | Schaevitz | A63B 1/00 482/142 |
| 5,257,701 | A | 11/1993 | Edelson | |
| 5,807,212 | A | 9/1998 | Nelson | |
| 5,813,947 | A | 9/1998 | Densmore | |
| 7,036,438 | B2 | 5/2006 | Okamoto et al. | |
| 7,537,553 | B2 | 5/2009 | Mongelluzzo et al. | |
| 7,614,991 | B2 * | 11/2009 | Fox | A63B 22/0235 482/126 |
| 7,686,742 | B2 | 3/2010 | Tischler et al. | |
| 7,901,331 | B1 | 3/2011 | Stoll | |
| D637,663 | S | 5/2011 | Boutchee | |

(Continued)

*Primary Examiner* — Gregory Winter
(74) *Attorney, Agent, or Firm* — Slater & Michaelson

(57) ABSTRACT

An exercise desk that includes a peripheral skirt having multiple corners; a plurality of rigid legs with one leg for support at a corner of the peripheral skirt; and a planar top work surface member supported by and over the peripheral skirt, and forming a desk work surface. The peripheral skirt is arranged with a front recessed cut-out section for accommodating a user of the exercise desk. The cut-out section is defined at least in part by opposed facing skirt walls. The desk also includes exercise elements in the form of a pair of parallel bars mounted respectively from the opposed facing skirt walls and accessible to the user of the exercise desk and a pull-up bar having opposed ends that are supported from the planar top work surface member adjacent respective opposed facing skirt walls.

20 Claims, 7 Drawing Sheets

(56) References Cited

U.S. PATENT DOCUMENTS

| | | | | |
|---|---|---|---|---|
| 8,062,195 | B2 * | 11/2011 | Israeli | A63B 1/00 482/131 |
| 8,734,302 | B2 * | 5/2014 | Hsieh | A63B 22/02 482/54 |
| 2009/0023566 | A1 * | 1/2009 | Florczak | A63B 1/00 482/142 |
| 2009/0062072 | A1 * | 3/2009 | Packham | A63B 22/02 482/4 |
| 2012/0055379 | A1 * | 3/2012 | Roberts | A47G 5/00 108/50.11 |
| 2014/0187383 | A1 * | 7/2014 | Martin | A47B 83/04 482/8 |
| 2016/0001116 | A1 * | 1/2016 | Prusaitis | A63B 1/00 482/38 |

* cited by examiner

EXERCISE DESK

RELATED CASE

Priority for this application is hereby claimed under 35 U.S.C. § 119(e) to commonly owned and U.S. Provisional Patent Application No. 62/178,194 which was filed on Apr. 2, 2015 and which is incorporated by reference herein in its entirety.

FIELD OF THE INVENTION

The present invention pertains in general to an exercise desk and, more particularly, to an exercise desk that readily enables the user to perform a multitude of different exercises directly at the desk.

BACKGROUND OF THE INVENTION

There presently exist some very limited forms of an exercise desk. By way of example, refer to U.S. Pat. No. 5,257,701 to Edelson and U.S. Pat. No. 5,813,947 to Densmore. However, none of the existing desk structures enable the user to use a substantial work surface while at the same time enabling the user to perform any one of a number of different exercise routines. Also, existing desk construction does not enable the desk user to easily either be seated at the desk or assume a standing position at the desk.

Accordingly, it is an object of the present invention to provide an improved exercise desk and one in which the user of the desk can readily perform a number of different exercises.

Another object of the present invention is to provide an improved exercise desk that is relatively simple in construction, that can be manufactured relatively economically and that is easy to assemble and dis-assemble.

SUMMARY OF THE INVENTION

To accomplish the foregoing and other objects, features and advantages of the present invention there is provided an exercise desk comprising: a peripheral skirt having multiple corners; a plurality of rigid legs with one leg for support at a corner of the peripheral skirt; and a planar top work surface member supported by and over the peripheral skirt, and forming a desk work surface. The peripheral skirt is arranged with a front recessed cut-out section for accommodating a user of the exercise desk. The cut-out section is defined at least in part by opposed facing skirt walls. The exercise desk further includes exercise means including a pair of parallel bars mounted respectively from the opposed facing skirt walls and accessible to the user of the exercise desk and a pull-up bar having opposed ends that are supported from the planar top work surface member adjacent respective opposed facing skirt walls.

In accordance with other aspects of the present invention there is provided wherein the cut-out section also is defined by an inner skirt wall that extends substantially orthogonal to the opposed facing skirt walls; including a slide drawer supported within the inner skirt wall; wherein each parallel bar has one end that is secured to the inner skirt wall; wherein each parallel bar has an opposed end that extends orthogonal to a longitudinal axis of the parallel bar; wherein the peripheral skirt is constructed of a metal, and both ends of each parallel bar are welded to the respective inner skirt wall and one of the opposed facing skirt walls; wherein the one end of each parallel bar is welded to the inner skirt wall outboard of the slide drawer; wherein the pull-up bar has a horizontal piece and two vertical pieces continuous with the horizontal piece forming a reverse U-shape; wherein the cut-out section defines opposed side work surface portions of the planar top work surface member; wherein the horizontal piece of the pull-up bar is supported in a direction that is substantially parallel to the inner skirt wall of the peripheral skirt; wherein the horizontal piece of the pull-up bar spans across the cut-out section and between a front edge of the peripheral skirt and the inner skirt wall; including support flanges; one supported at each of the opposed side work surface portions of the planar top work surface member; wherein the vertical pieces of the pull-up bar are received at the respective support flanges; wherein each of the vertical pieces are releasably received in a corresponding support flange; including lighting provided on the pull-up bar; wherein the lighting is provided on the horizontal piece of the pull-up bar; including speakers disposed on the pull-up bar; and wherein the speakers are provided at the respective vertical pieces of the pull-up bar.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 4:
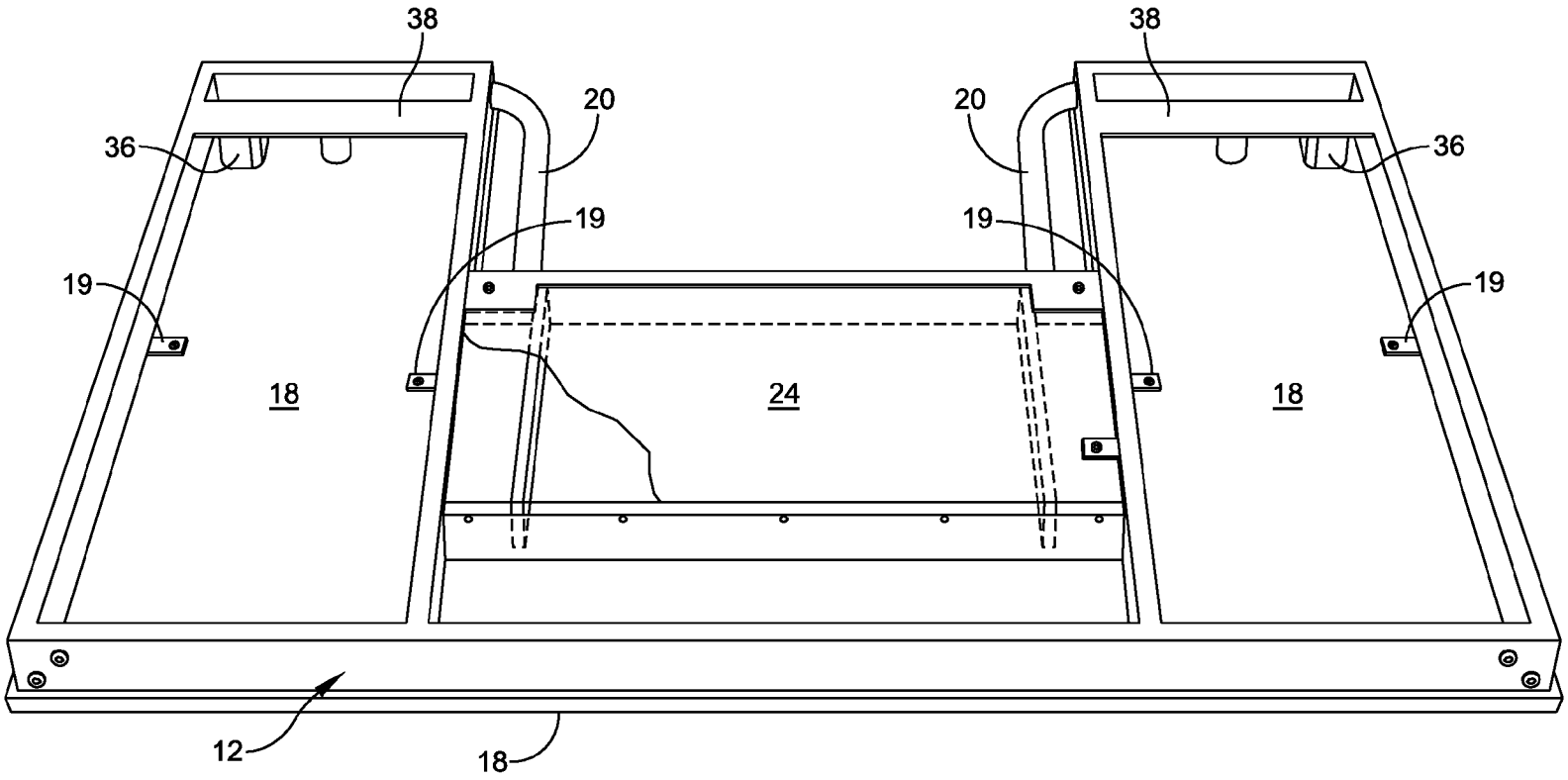
FIG. 4 is a bottom view of the exercise desk illustrated in FIGS. 1-3 with the legs removed in order to show further internal details.
Figure 5:
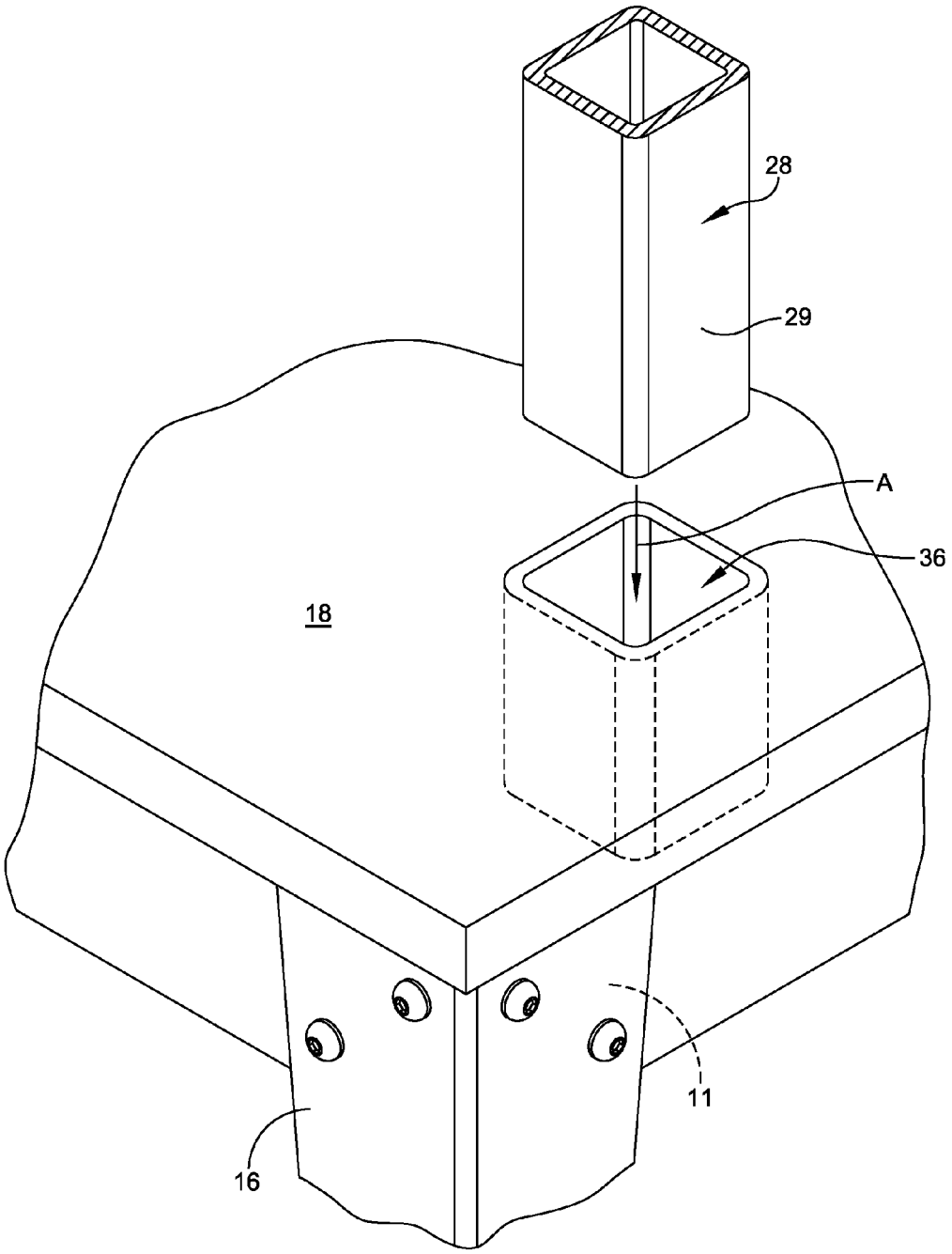
FIG. 5 is a fragmentary view of the exercise desk particularly taken at a corner where the pull up bar is mounted.
Figure 6:
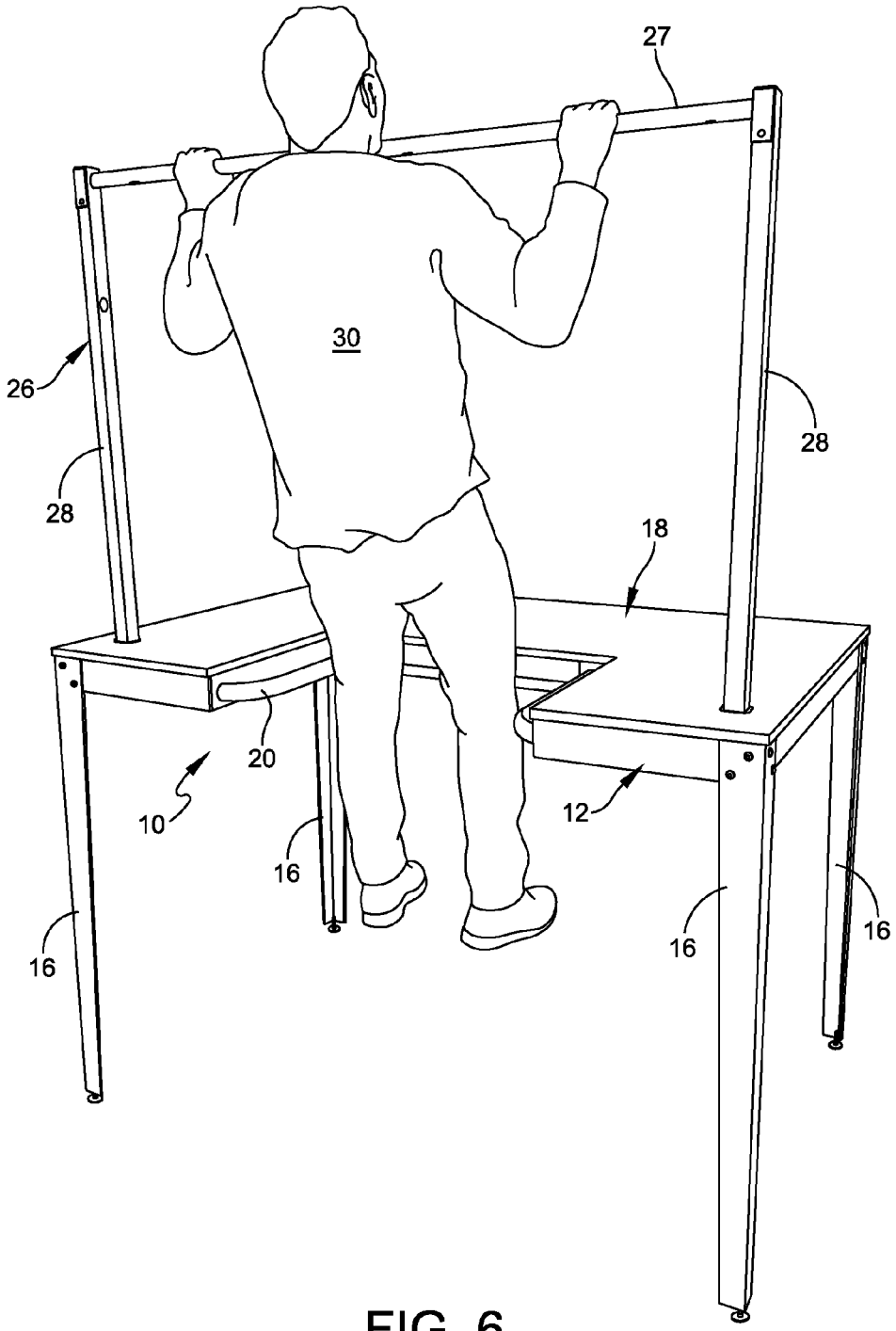
FIG. 6 is a perspective view of the exercise desk of the present invention showing a user performing an exercise on the pull-up bar.
Figure 7:
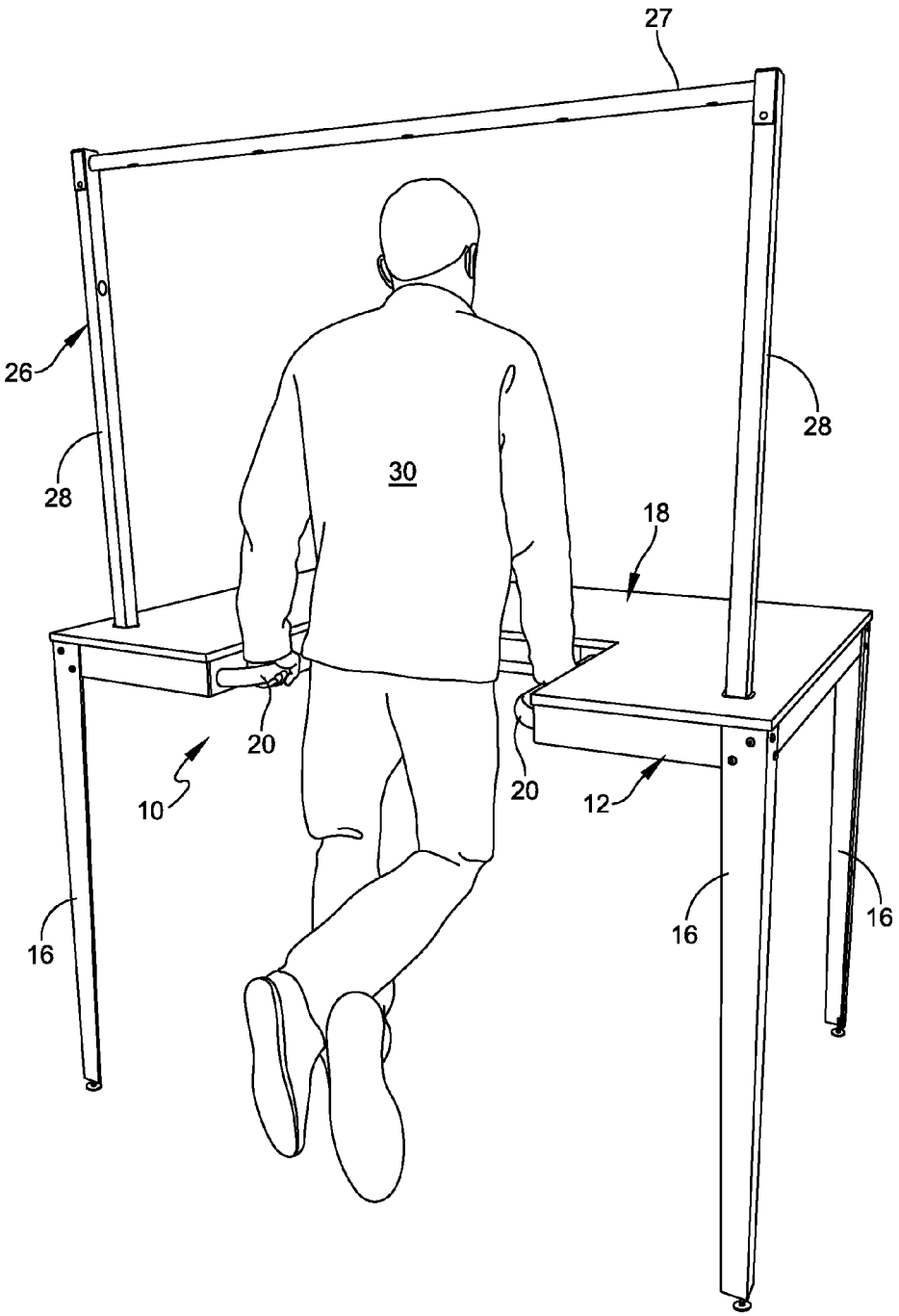
FIG. 7 is a perspective view of the exercise desk of the present invention showing a user performing an exercise on the opposed parallel bars.

The exercise or fitness desk of the present invention is illustrated in FIGS. 1-7. In particular, FIGS. 6 and 7 show the user of the desk performing different exercises. Accordingly, the desk has a pull-up bar 26 above the user's head including a horizontal piece and vertical supports at each side of the desk. The desk also has parallel dip bars, illustrated at 20, at each side of the user. The user accesses the desk by standing in a center cutout section 13. The exercise desk illustrated herein allows the user to stand in an upright or standing position while maintaining a proper posture. Also, the exercise elements in the form of a pull-up bar and dip bars allow the user to engage in movement and stretching throughout the workday while still performing desk related tasks. The exercise desk that is illustrated preferably also has a substantial size work area while yet providing for the exercise mechanisms.

The exercise desk that is illustrated herein may be considered as generally in a U-shape whereby the user accesses the desk in a standup position. A chair is shown in dotted outline in FIG. 1 that can be used by the user. The desk encourages movement by incorporating the pull-up bar 26 and the dip bars 20. The user accesses the desk by standing in the cutout section 13 in the U-shape of the desk. The desk may be custom ordered to the particular height of the user. This customization is accomplished by providing different length legs 16; such as respective lengths of 35", 38" or 41".

The exercise desk illustrated in the drawings offers the user an alternative to doing work in a seated position. Thus, even though a somewhat high seat is shown in dotted outline in FIG. 1, the desk is capable of use without a seat. There are numerous advantages and benefits to working in a standing position and having access to movement and stretching throughout the day. The pull-up bar allows the user to stretch and strengthen arms, shoulders, neck and back muscles while increasing blood flow. The dip or parallel bars are beneficial to the exercise of chest, arm, shoulder and core muscles. The bars 20 can also be used for balance while engaging the legs and lower back in squats and lunges. The majority of the components of the desk may be constructed of a metal such as steel or aluminum. The desk top can be constructed of a wood material, a stone material or other eco-friendly materials.

The exercise desk of the present invention is preferably constructed of a metal material such as steel with the exception of the desk top work surface which may be constructed of wood, veneer or a solid surface material such as marble, granite or a composite. The main structural support of the exercise desk may be in the form of a one inch by two inch steel rectangular tube skirt 12 which is under the desk surface and follows the desk surface perimeter. This steel skirt is provided in one piece sections which is welded at all corners and is used for the support of the parallel bars and also includes means as described in the drawings for supporting the pull-up bar. The steel skirt is attached to the underside of the work surface.

The pull-up bar may be comprised of a length of one inch steel pipe which may be bent in the desired form as illustrated in the drawings or may be provided in separate vertical and horizontal pieces. The pull-up bar is preferably removable for shipping purposes. This bar drops into two round steel flanges which are flush with the top of the desk surface.

The parallel bars may be constructed of one inch steel pipe and are welded to the steel skirt. The parallel bars are mounted within the cutout section to opposed side walls and an inner wall of the skirt. The four legs 16 which support the desk surface are constructed from angle iron which may be ¼ inch thick. The steel legs are preferably removable for ease of shipping and each attachable with at least two screws and preferably four steel screws per leg. The steel legs attach at the four corners of the desk.

As also illustrated herein there are LED lights at the upper portion of the pull-up bar that may be battery operated. These may be disposed in small recesses or holes within the pull-up bar. Blue Tooth® (wireless method for sending data between devices) speakers are battery operated and fit to a ½ inch diameter hole in the vertical portion of the pull-up bar. At the center of the desk there is preferably a steel drawer which is at least three inches deep and which is slidably mounted.

Figure 2:
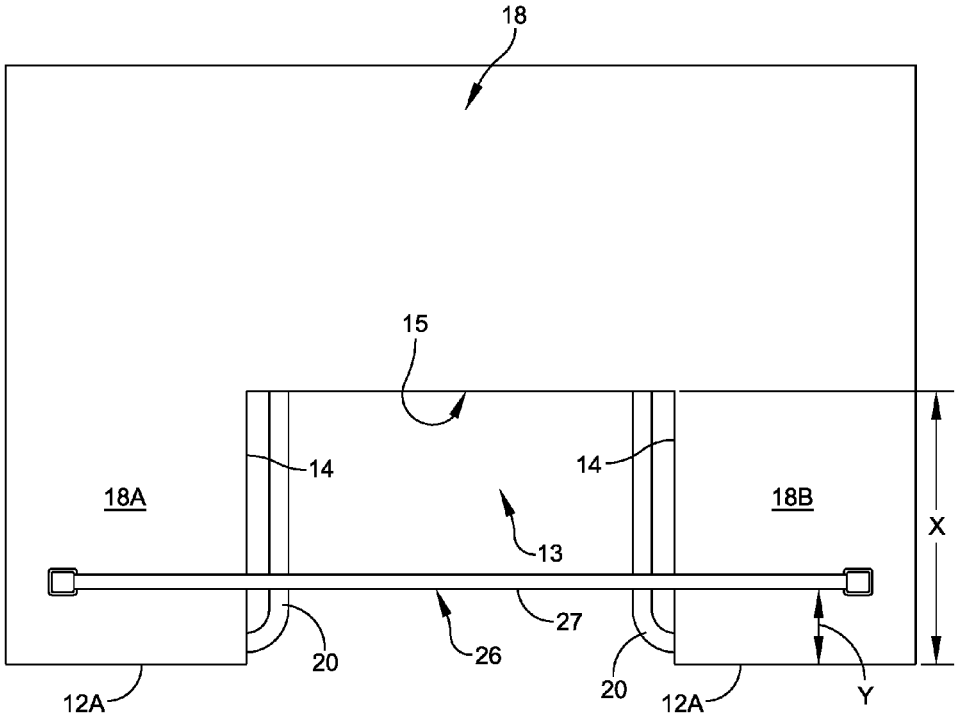
FIG. 2 is a plan view of the exercise desk of FIG. 1
Figure 3:
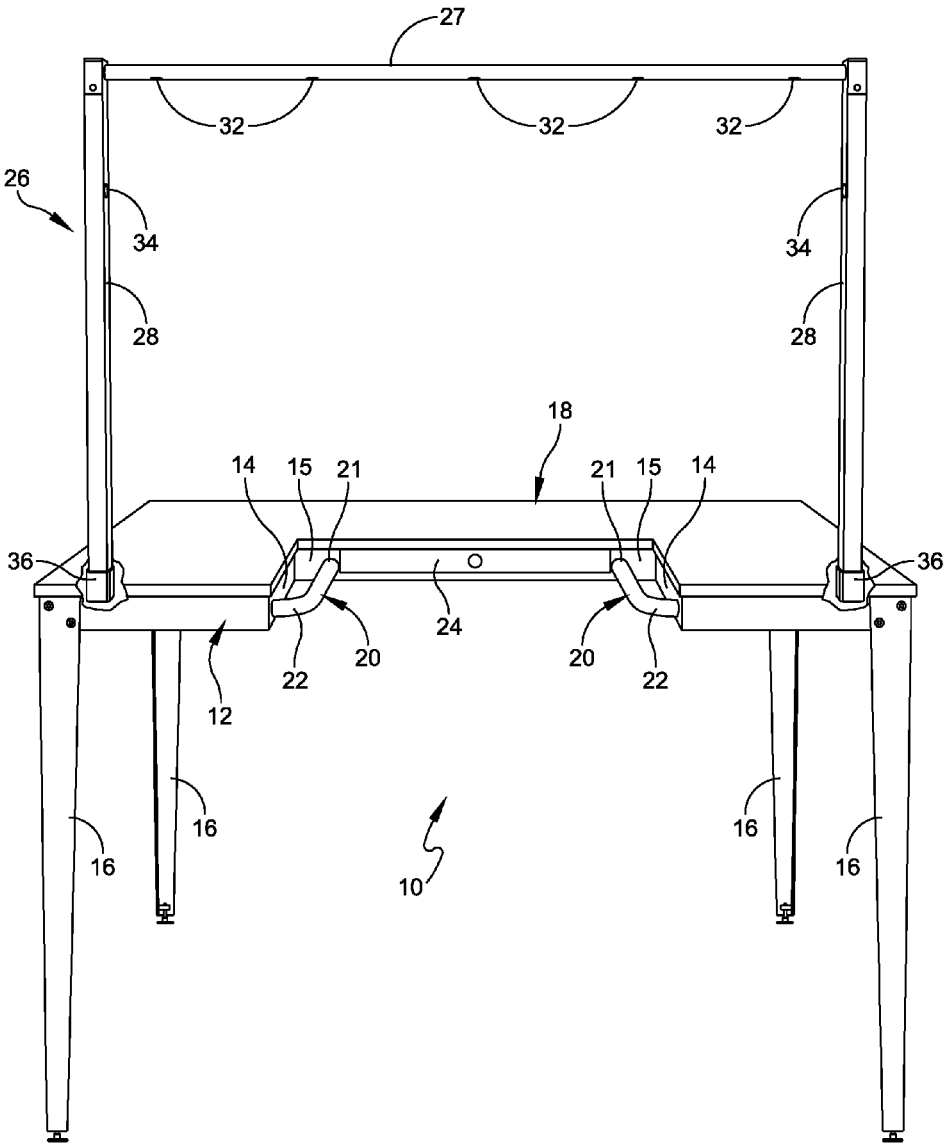
FIG. 3 is a front perspective view of the exercise desk illustrated in FIGS. 1 and 2.

With respect to the exercise desk illustrated in FIGS. 1-7, there is illustrated a desk at 10. The desk 10 is comprised of a peripheral skirt 12 having multiple corners such as illustrated by a dotted lead line at 11 in FIG. 1. In the particular embodiment illustrated in the drawings, the peripheral skirt may be considered as having four outer corners and also a set of four inner corners defined by the cutout section 13. The peripheral skirt 12 may be comprised of a metal material such as steel. In one embodiment the main part of the skirt 12 may be constructed of one inch by 3 inch rectangular tubing. Metal corner pieces may also be provided particularly at the inner section where the cutout section 13 is provided. These corner cover plates may be metal. The bottom view of FIG. 4 illustrates the configuration of the peripheral skirt. FIG. 4 also illustrates the placement of the center drawer 22 and further illustrates the positioning of the support flanges 36.

Figure 1:
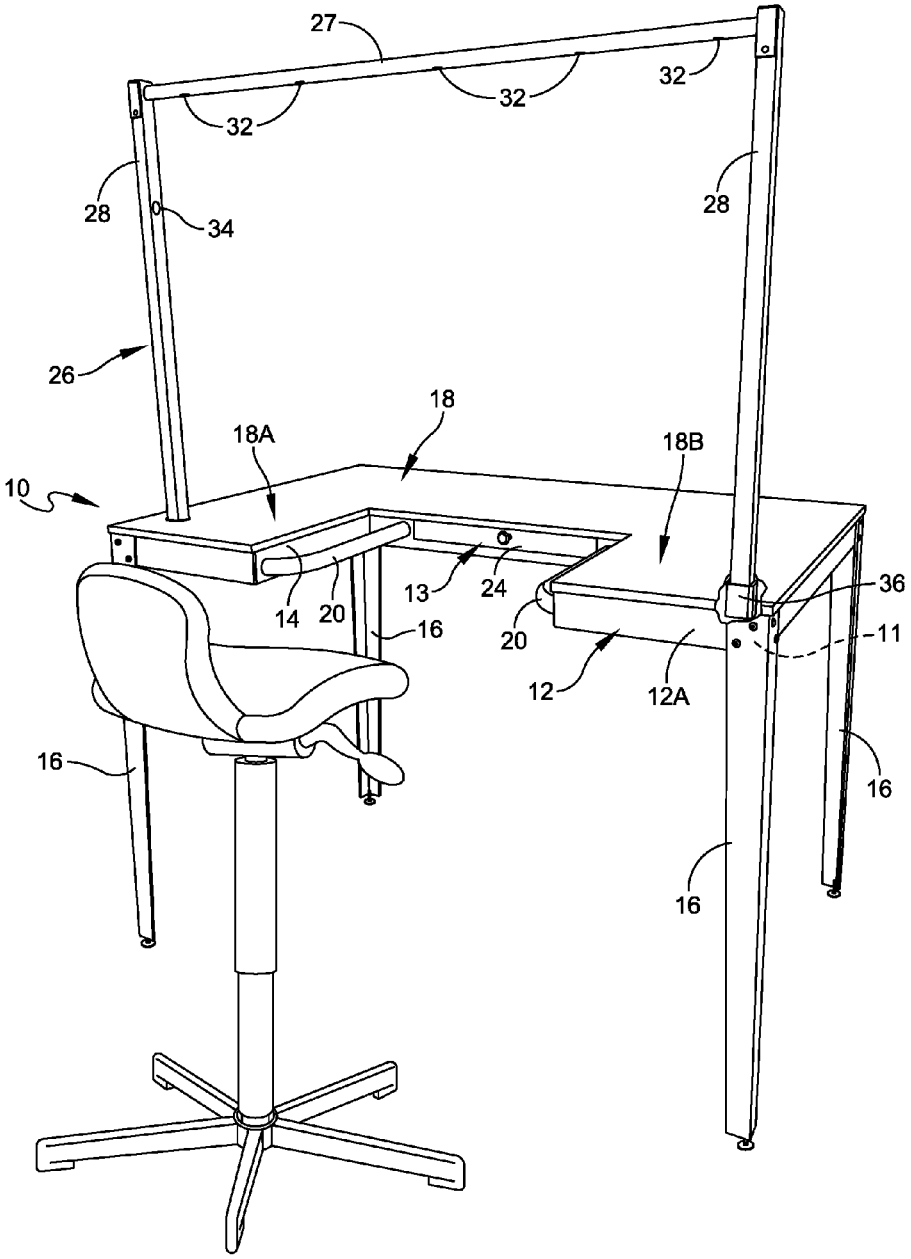
FIG. 1 is a perspective view f one embodiment of the exercise desk of the present invention.

FIGS. 1 and 3 also illustrate the support legs 16. Each of these legs 16 may be constructed of a metal material and are secured at the respective corners by appropriate screws or bolts. As indicated previously, the legs 16 can be provided in different lengths to suit the particular user. Each of the legs 16 is secured at a corner 11 of the peripheral skirt 12.

The exercise desk of the present invention is also comprised of a planar top work surface member 18. This may be constructed of a variety of different materials including plywood and other synthetic materials. The member 18 is supported by and over the peripheral skirt 12. In the bottom view of FIG. 4 the underside of the planar top work surface member 18 is shown. Also shown in FIG. 4 are clips 19 that may be used for securing the planar top work surface member to the peripheral skirt. As indicated previously, the peripheral skirt is arranged with a front recessed cutout section 13 for accommodating the user of the exercise desk. This cutout section 13 is defined, at least in part, by opposing facing skirt walls 14 and an inner wall 15. The plan view of FIG. 2 illustrates the position of the sidewalls 14 and the inner wall 15. These various walls comprising the peripheral skirt may be attached together in a variety of different ways such as by being welded where corners appear. The cutout section is preferably rectangular having a depth that is slightly smaller than the width of the cutout section 13. This is clearly illustrated in the plan view of FIG. 2 as well as in the front view of FIG. 3.

The exercise desk of the present invention also includes a pair of parallel bars 20 mounted respectively from the opposed facing skirt walls 14 and also accessible to the user of the exercise desk. In this regard refer to FIG. 7 which shows the user at 30 engaged with the respective parallel bars 20. Each of the parallel bars 20 has one end 21 that is secured to the inner wall 15. This may be secured by being welded to the inner wall 15 of the skirt 12. Each of the parallel bars 20 also has an opposed end at 22 that essentially extends orthogonal to a longitudinal axis of the parallel bar. The end 22 is preferably welded or secured in another manner to one of the opposed walls 14 at the center cutout section 13.

Within the center cutout section 13 there is also preferably provided a drawer 24. The drawer extends along a portion of the width of the cutout section and terminates on the inside of either of the parallel bars 20. The bottom view of FIG. 4 illustrates the position of the drawer 24 supported at the inner wall 15 of the skirt. Other support mechanisms may be provided for the drawer that can be of a conventional nature to enable the drawer 24 to be readily pulled out and pushed in.

In addition to the parallel bars 20, a further unique feature of the present invention is the use of a pull-up bar 26 having opposed ends that are supported from the planar top work surface member 18 adjacent respective opposed facing skirt walls 14. In this regard reference may be made to the top member 18 and the respective areas 18A and 18B adjacent to the cutout section 13. FIG. 2 clearly illustrates the position of the pull-up bar relative to the cutout section 13. FIG. 2 illustrates the depth of the cutout section by the dimension X and furthermore illustrates the placement of the pull-up bar in a forward to back direction as indicated by the dimension Y. This pull-up bar 26 extends substantially parallel to the front edge 12A of the skirt 12. The pull-up bar 26 is positioned in a preferred area with the ends thereof supported at locations of the member area 18A, 18B. In this regard, it is preferred that the dimension Y illustrated in FIG. 2 be in a range of 0.1 to 0.4 of the dimension X. In FIG. 2 the dimension Y is on the order of 0.3 of the dimension X.

The pull-up bar 26 includes a horizontal piece 27 and two vertical pieces 28 that are contiguous with the horizontal piece forming sort of a reverse U-shape configuration. As indicated previously, the cutout section 13 defines the opposed side work portion 18A and 18B of the planar top work surface member. The horizontal piece 27 is supported in a direction that is substantially parallel to the inner skirt wall of the peripheral skirt. The horizontal piece 27 spans across the cutout section 13 and between the front edge 12A of the peripheral skirt and the inner skirt wall 15. Again, refer to the plan view of FIG. 2. The pull-up bar 26 is preferably readily removable from the member 18 and preferably is not secured in a fixed manner with the member 18. For this purpose, there are provided support flanges 36 shown in FIGS. 4 and 5. These flanges 36 are supported in a fixed manner such as by being welded to a cross bar 38 shown in FIG. 4. Each of the flanges 36 extends through a hole in the planar top member 18. Thus, each of the flanges 36 is readily available. FIG. 5 illustrates a bottom end 29 of one of the vertical pieces 28 of the pull-up bar 26 being engaged in a direction of arrow A into one of the flanges 36. The other vertical piece 28 is supported in the same manner.

Another feature of the present invention is the provision for lighting associated in particular with the pull-up bar 26. This is illustrated in FIGS. 1 and 3 by a series of spaced apart LED sources shown at 32. These may connect to an energy source which may be battery operated. Also associated with the pull-up bar 26, and in particular the vertical pieces 28, are respective Blue Tooth® speakers 34. FIG. 3 shows one of these positioned in association with each of the vertical pieces 28. These speakers are preferably disposed at a position close to the opposed ears of the user when the pull-up bar is being used as in FIG. 6. FIG. 7 shows the user exercising with the parallel bars 20.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. An exercise desk comprising:

a peripheral skirt having multiple corners;

a plurality of rigid legs with one leg of the plurality of legs for support at a respective corner of the peripheral skirt;

a planar top work surface member supported by and over the peripheral skirt, and forming a desk work surface;

said peripheral skirt arranged with a front recessed cut-out section for accommodating a user of the exercise desk;

said cut-out section defined at least in part by opposed facing skirt walls;

a pair of parallel bars mounted respectively from the opposed facing skirt walls and accessible to the user of the exercise desk;

and a pull-up bar having opposed ends that are supported from the planar top work surface member adjacent respective opposed facing skirt walls.

2. The exercise desk of claim 1 wherein the cut-out section also is defined by an inner skirt wall that extends orthogonal to the opposed facing skirt walls.

3. The exercise desk of claim 2 including a slide drawer supported within the inner skirt wall.

4. The exercise desk of claim 2 wherein each parallel bar has one end that is secured to the inner skirt wall.

5. The exercise desk of claim 4 wherein each parallel bar has an opposed end that extends orthogonal to a longitudinal axis of the parallel bar.

6. The exercise desk of claim 5 wherein the peripheral skirt is constructed of a metal, and both ends of each parallel bar are welded to the respective inner skirt wall and one of the opposed facing skirt walls.

7. The exercise desk of claim 6 including a slide drawer supported within the inner skirt wall, and wherein the one end of each parallel bar is welded to the inner skirt wall outboard of the slide drawer.

8. The exercise desk of claim 1 wherein the pull-up bar has a horizontal piece and two vertical pieces continuous with the horizontal piece forming a reverse U-shape.

9. The exercise desk of claim 8 wherein the cut-out section defines opposed side work surface portions of the planar top work surface member.

10. The exercise desk of claim 9 wherein the cut-out section is defined by an inner skirt wall and the horizontal piece of the pull-up bar is supported in a direction that is parallel to the inner skirt wall of the peripheral skirt.

11. The exercise desk of claim 10 wherein the inner skirt wall extends orthogonal to the opposed facing skirt walls and the horizontal piece of the pull-up bar spans across the cut-out section and between a front edge of the peripheral skirt and the inner skirt wall.

12. The exercise desk of claim 11 including support flanges; with one support flange being supported at each of the opposed side work surface portions of the planar top work surface member.

13. The exercise desk of claim 12 wherein the vertical pieces of the pull-up bar are received at the respective support flanges.

14. The exercise desk of claim 13 wherein each of the vertical pieces is releasably received in a corresponding support flange.

15. The exercise desk of claim 12 including lighting provided on the pull-up bar.

16. The exercise desk of claim 15 wherein the lighting is provided on the horizontal piece of the pull-up bar.

17. The exercise desk of claim 16 including speakers disposed on the pull-up bar.

18. The exercise desk of claim 17 wherein the speakers are provided at the respective vertical pieces of the pull-up bar.

19. The exercise desk of claim 2 wherein each parallel bar has one end that is secured to the inner skirt wall, and wherein each parallel bar has an opposed end that extends orthogonal to a longitudinal axis of the parallel bar.

20. The exercise desk of claim 19 wherein the peripheral skirt is constructed of a metal, and the one end of each parallel bar is welded to the inner skirt wall and one of the opposed end of each parallel bar is welded to one of the facing skirt walls.

* * * * *